United States Patent [19]

Hawkins

[11] Patent Number: 4,768,536

[45] Date of Patent: Sep. 6, 1988

[54] MOTORIZED WALKER

[76] Inventor: Junior F. Hawkins, 3120 W. 16th, Wichita, Kans. 67203

[21] Appl. No.: 22,652

[22] Filed: Mar. 6, 1987

[51] Int. Cl.[4] ..... A61H 3/00

[52] U.S. Cl. ..... 135/67; 272/70.4; 180/907

[58] Field of Search ..... 135/67, 68; 180/907; 280/242 WC, 289 WC, 7.1, 87.1, 250; 318/139

[56] References Cited

U.S. PATENT DOCUMENTS

| | | | |
|---|---|---|---|
| 2,621,707 | 12/1952 | Ames | 280/242 WC |
| 3,485,510 | 12/1969 | Merlan | 280/250 |
| 3,493,245 | 2/1970 | Nabinger | 280/250 |
| 4,415,049 | 11/1983 | Wereb | 180/907 |
| 4,422,515 | 12/1983 | Loveless | 180/907 |

*Primary Examiner*—Robert A. Hafer

*Assistant Examiner*—Charles H. Sam

*Attorney, Agent, or Firm*—John Wade Carpenter

[57] ABSTRACT

The Motorized Walker is a device containing a frame assembly which a person walking can hold onto for support and help prevent a fall which might otherwise occur. This device need not be picked up between steps since an electric switch mechanism will activate a motor which will move the device the distance required between steps. This motorized feature permits support to be available at all times and the person using the device to walk faster than might otherwise be possible. This device also permits a person to walk where picking up a non-motorized walker might result in a fall since support is removed while the unit is being moved or where picking up a non-motorized walker is a formidable task.

8 Claims, 1 Drawing Sheet

MOTORIZED WALKER

BACKGROUND OF THE INVENTION

1. Field of the Invention

This invention relates to a method whereby a motorized device is used to support a person who otherwise might fall or have difficulty walking.

2. Description of the Prior Art Prior to my invention there were no motorized walkers.

SUMMARY

The Motorized Walker is a device which helps support a person in such a manner that the person using the device is not likely to fall while walking. This device also permits a person to walk who might otherwise find it impossible or extremely difficult to do so.

The manual walkers which were available prior to my invention had to be picked up by the person using them.

This created two problems. The first problem was the effort and difficulty encountered in having to pick the unit up and place it in front of you so another step could be taken. For some, this could be considered a formidable task. In addition, while the manual walker was in the air being moved to its new location, there was little support available for the person using the walker and a fall could easily occur during this transition period.

With the Motorized Walker these problems are eliminated. The Motorized Walker can be moved to its new location without being picked up by the person using the device. This device, being motorized, can be moved to its new location by engaging a switch. Furthermore, since the device does not have to be picked up, there is support available for the person using the device at all times which helps prevent falls.

In addition, since the Motorized Walker does not have to be picked up for each step, the person using this device can walk farther and faster than might otherwise be possible with a manual walker.

The electric controls are arranged in such a manner that if the operator fails to disengage the switch, when the Motorized Walker achieves the maximum reach of the person using the device, the operators hand will be pulled from the switch and movement of the Motorized Walker will be halted. This device will not roll without power being applied since the drive mechanism and its associated gear reductions are not free-wheeling.

The present invention accomplished its desired objects by providing a motorized walker comprising a frame having a lower front and a lower rear and including an axle means rotatably secured to the lower front of the frame. A pair of front wheels is rotatably secured to the axle means for supporting the frame. A pair of swivel type caster wheels is secured to the lower rear. A front compartment means is secured to the lower front and extends substantially across the entire length of the lower front. A motor means is secured in the front compartment; and a power source means is disposed in the front compartment and is electrically engaged to the motor means to supply power to the same. A control circuit means is secured to the frame and is electrically engaged to the motor means and to the power source means. A coupling means is engaged to the motor means and to the axle means for transferring rotational energy from the motor means to the axle means.

The control circuit means comprises the first integrated circuit means; a second integrated circuit means connected electrically in series with the first integrated circuit means; a first resistor secured electrically between the first and the second integrated circuit means; a third integrated circuit means secured electrically in series with the second integrated circuit means; a second resistor secured electrically between the second and the third integrated circuit means; a first transistor having a first transistor base connected electrically in series with the third integrated circuit means and further including a first collector and a first emitter; a third resistor secured electrically between the third integrated circuit means and the first transistor base; a second transistor having a second transistor base connected electrically in series with the first emitter and further including a second collector and a second emitter; a fourth resistor secured electrically between the first emitter and the second transistor base; and a third transistor having a third transistor base connected electrically in series to the second emitter and further including a third collector and a third emitter that is electrically grounded. The second collector is engaged electrically to a diode to prevent feedback voltage from destroying the third transistor and the second transistor when the motor means shuts off and its magnetic field collapses. A first switch means is engaged electrically to the second collector and to the third collector and to the motor means. A fifth resistor is engaged electrically to the second transistor base and to the fourth resistor to insure that when no positive pulse is sent to the second transistor base, the second transistor is in an off condition. A first variable resistor is engaged to the power source, a second variable resistor is connected in series with the first variable resistor and is electrically engaged to the third integrated circuit means; and a third variable resistor is electrically engaged to the second variable resistor and is electrically grounded. A sixth resistor is electrically engaged to the power source and to the first and the second integrated circuit means and a seventh resistor is electrically grounded and is electrically secured to the first and the second integrated circuit means. The sixth and seventh resistor provides a reference voltage for the first integrated circuit means. An eighth resistor is electrically engaged from the first integrated circuit means across the second integrated circuit means and electrically engages to the second resistor between the second and the third integrated circuit means. A ninth resistor is electrically engaged to the first resistor between the first and the second integrated circuit means and to the eighth resistor. A capacitor is secured electrically across the second integrated circuit means to determine a period of oscillation of a square wave generated by the first integrated circuit means.

BRIEF DESCRIPTION OF THE DRAWINCS

DESCRIPTION OF THE PREFERRED EMBODIMENT

Figure 1:
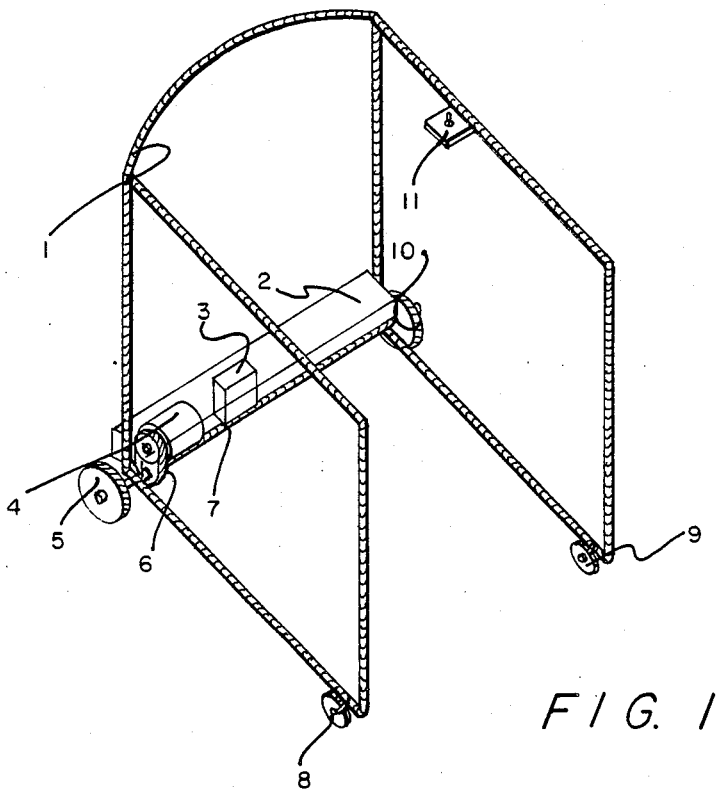
FIG. 1 is a perspective view of the Motorized Walker.

Referring to FIG. 1, the frame 1 is constructed in such a manner as to provide support and easy access and exiting for the person using the device. The use of tubular construction is anticipated for said frame 1 even though other material and construction type and methods could also be used as long as such methods and material provides adequate support for the operator and for the related equipment attached to said frame 1.

Attached to said frame 1 is a front compartment 2. Said front compartment 2 is a rectangular box type unit with a hinged lid permitting access to the interior of said front compartment 2. Said front compartment 2 houses motor 4; battery 3 and related components. Said front compartment 2 may be constructed from plastic, metal or other suitable material and be of various shapes and sizes which will permit efficient operation of this device. The primary purpose of said front compartment 2 is to provide a location for the various electrical and drive mechanism associated with the device and to provide a water resistant enclosure for said material. Said front compartment 2 also provides the operator with protection from the drive unit and related assembly.

Said motor 4 is powered by said battery 3. Said battery 3 is a 12-volt automotive type lead-acid battery but other type of batteries both in construction and sizes may be used for this device. In additon, gasoline engines and other type of power devices may be used.

Said motor 4 is attached to said front compartment 2 by screws or other suitable means which securely holds said motor 4 in its proper location. Said battery 3 is also secured to front compartment 3 by screws or other standard battery hold-down means.

Said motor 4 contains a sprocket means which turns a drive chain 6. Said drive chain 6 also turns a sprocket means associated and attached by suitable means to front drive wheel 5. Said drive means may be a belt and pulley mechanism or could be a direct gear driven assembly. The preferred embodiment is such that the front drive wheel 5 will turn when said motor 4 is energized by control circuit 11 and said battery 3.

Attached to said motor 4 is a standard gear reduction mechanism which is commercially available and permits said drive wheel 5 to turn only when the motor is energized and the driving mechanism is activated. This feature permits solid support for the operator at all times since the device will not freely roll...

Said front drive wheel 5 and front wheel 10 are attached to axle 7 by standard means and said axle 7 is secured to said frame 1 in such a manner that said front wheel 5 and front wheel 10 supports said frame 1.

Rear caster 8 and rear caster 9 are attached to frame 1 in a standard manner with bolts, screws or by welding or other conventional means which will support said frame 1. Said caster 8 and caster 9 permits steering of said Motorized Walker since they are swivel type casters. Said caster 8 and said caster 9 could be located at the front of the device and the drive mechanism could be a rear driven assembly and still not depart from the spirit of this invention.

Said control circuit 11 is attached to frame 1 with screws or other suitable means which permits easy access to said control circuit 11 by the operator of said Motorized Walker.

Figure 2:
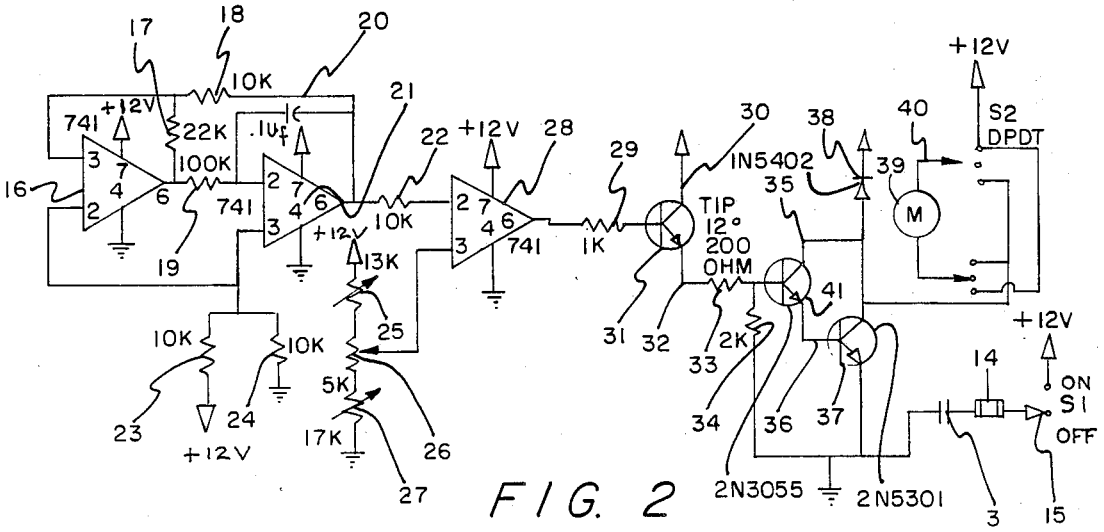
FIG. 2 is a schematic of the electronic circuit for the Motorized Walker.

FIG. 2 is a electronic schematic of the electronic control circuit 11 which controls the speed and direction of said Motorized Walker.

Power for said electronic circuit is provided by said battery 3 which is a conventional twelve-volt lead-acid battery. Other power means and battery values could also be used.

The said battery 3 output voltage is routed through fuse 14 which prevents an overload and subsequent destruction of said electronic circuit in case of a malfunction of one or more circuit components. The said power from said battery 3 is then routed through an on-off switch 15. With said switch 15 in the off position, no power will be provided circuit components but with said power switch 15 in an on position, power will be provided to all circuit components in said electronic circuit.

Integrated circuit 16 is connected in such a manner that when power is applied, there will be a square wave generated at pin 6 of said integrated circuit 16. A triangle wave will also be generated at pin 6 of integrated circuit 21. Said integrated circuit 21 is wired as an integrator and the output is fed back to said integrated circuit 16 which compares said triangle wave from pin 6 of said integrated circuit 21 with the reference voltage at pin 2 of said integrated circuit 16. When said reference voltage which is provided by resistor 23 and resistor 24, is greater than the value of the triangle wave provided at pin 6 of said integrated circuit 16, the output is low at pin 6 of said integrated circuit 16. Whenever said triangle wave amplitude is greater than the reference voltage, said output at pin 6 of said integrated circuit 16 goes high and this high and low condition creates a square wave output.

The period of oscillation of said square wave is determined by the capacitor 20 connected to pin 6 and pin 2 of said integrated circuit 21. The ratio of resistor 18 to resistor 17 determines the amplitude of said triangle wave generated at pin 6 of said integrated circuit 21.

The output of said integrated circuit 21 at said pin 6 is routed to integrated circuit 28 through a current limiting resistor 22.

Connected to pin 3 of said integrated circuit 28 are variable resistors 25, 26 and 27. Said variable resistors 25, 26 and 27 are used to provide a variable positive voltage at pin 3 of said integrated circuit 28. The value of said voltage provided at pin 3 by said resistor 26 determines the output pulse at pin 6 of said integrated circuit 28.

The said output pulse at pin 6 of said integrated circuit 28 is low whenever the triangle wave fed to pin 2 of said integrated circuit 28 is greater in value than the said reference voltage provided at pin 3. If said triangle wave value is less than said reference voltage, then the voltage at pin 6 of said integrated circuit 28 is a positive value which permits said motor 39 to be energized when desired.

By setting or adjusting the reference voltage, various duty cycles or ratios of on to off times can be sent to said motor 39. A duty cycle close to 100% occurs when the pulse is a constant high which will cause said motor 39 to run at maximum speed when energized. A lower duty cycle is also possible and said motor 39 will run at a speed which is proportional to the duty cycle which is determined by said reference voltage provided at pin 3 of said integrated circuit 28.

The output of said integrated circuit 28 is fed to transistor 31 through a 1K ohm current limiting resistor 29. Said transistor 31 is a standard commercially available darlington transistor with its collector 30 wired to the positive 12-volt supply. The emitter 32 is connected to the 200 ohm resistor 33. Said resistor 33 is a current limiting resistor which is connected to a 2K ohm resistor 34 and to a power transistor 41. Said resistor 34 is used to insure that when no positive pulse is sent to the base of said transistor 41, that said transistor 41 will be in an off condition. The collector 35 of said transistor 41 and transistor 37 are connected together so each can provide current for said motor 39 when activated by switch 40. Also connnected to said collector 35 is diode 38 which is used to prevent feedback voltage from destroying said transistor 37 and said transistor 41 when said motor 39 shuts off and its magnetic field collapses.

Connected to said collector 35 of said transistor 37 and said transistor 41 is said switch 40 which is a double-pole double-throw switch with a spring return center-off position. Normal position is off which means that said transistor 37 and said transistor 41 cannot be connected to said motor 39 and the positive voltage supply. Therefore, the unit is in an off state. When said switch 40 is placed in a forward position, then the 12-volt positive supply voltage is connected to said motor 39 and the opposite side of said motor 39 is connected to said collectors of said transistor 37 and said transistor 41. With this connection completed, current can flow and said motor 39 will run.

If said switch 40 is placed in a reverse position, then the said collector 35 will be connected to the positive side of said motor 39 and the positive voltage supply will be connnected to the negative side of said motor 39 and the permanent magnet type of motor will run in reverse.

Since said switch 40 has a normal spring-return off position, if the operator's hand is removed from said switch 40, said switch 40 will return to a off position and said Motorized Walker will stop. As a result of this feature, once the switch position exceeds the reach of the operator, the operator's hand will be pulled from said switch 40 and the Motorized Walker will stop. This means said Motorized Walker will never be outside the reach of the operator. The operator, by proper operation of said switch 40 can move the said Motorized Walker any distance desired as long as it doesn't exceed the reach of said operator. The speed control associated with said control circuit 11 also permits various speed to be selected by the operator to suit their particular walking speed.

A reverse function available through proper operation of said switch 40 also permits said Motorized Walker to run in a reverse manner.

Said motor 39 is a 12-volt direct-current motor which is commercially available with a gear reduction box attached. Other motor types and configurations will also permit efficient operation of said device. Said gear reduction permits the device to stop quickly and not roll when said motor 4 is de-energized.

While the above description contains many specifities, these should not be construed as a limitation on the scope of the invention, but rather as an exemplification of one preferred embodiment thereof. Many other variations in size, shape and material are possible such as the device could be fully enclosed; there could be a single front or rear drive wheel and still remain within the spirit of this invention. Therefore, the scope of the invention should be determined not by the embodiment illustrated but by the appended claims and their legal equivalents.

What I claim is:

1. A motorized walker comprising a frame having a lower front and a lower rear and including an axle means rotatably secured to the lower front of said frame; a pair of front wheels rotatably secured to the axle means for supporting said frame; a pair of swivel type caster wheels secured to the lower rear; a front compartment means secured to the lower front and extending substantially across the entire length of said lower front; a motor means secured in said front compartment for producing rotational energy; a power source means disposed in said front compartment and electrically engaged to said motor means to supply power to the same; a control circuit means secured to the frame and electrically engaged to said motor means and to said power source means; and a coupling means engaged to said motor means and to said axle means for transferring rotational energy from the motor means to the axle means;

said control circuit means comprises a first integrated circuit means; a second integrated circuit means connected electrically in series with said first integrating circuit means; a first resistor secured electrically between said first and said second integrated circuit means; a third integrated circuit means secured electrically in series with said second integrated circuit means; a second resistor secured electrically between the second and the third integrated circuit means; a first transistor having a first transistor base connected electrically in series with said third integrated circuit means and further including a first collector and a first emitter; a third resistor secured electrically between the third integrated circuit means and the first transistor base; a second transistor having a second transistor base connected electrically in series with said first emitter and further including a second collector and a second emitter; a fourth resistor secured electrically between the first emitter and the second transistor base; and a third transistor having a third transistor base connected electrically in series to said second emitter and further including a third collector and a third emitter that is electrically grounded.

2. The motorized walker of claim 1 wherein said second collector is engaged electrically to a diode to prevent feedback voltage from destroying the third transistor and the second transistor when the motor means shuts off and its magnetic field collapses.

3. The motorized walker of claim 2 additionally comprising a first switch means engaged electrically to said second collector and to said third collector and to said motor means.

4. The motorized walker of claim 3 additionally comprising a fifth resistor engaged electrically to said second transistor base and to said fourth resistor to insure that when no positive pulse is sent to the second transistor base, the second transistor is in an off condition.

5. The motorized walker of claim 4 additionally comprising a first variable resistor engaged to said power source, a second variable resistor connected in series with said first variable resistor and electrically engaged to said third integrated circuit means; and a third variable resistor electrically engaged to said second variable resistor and electrically grounded.

6. The motorized walker of claim 5 additionally comprising a sixth resistor electrically engaged to the power source and to the first and the second integrated circuit means and a seventh resistor electrically grounded and electrically secured to said first and said second integrated circuit means, said sixth and seventh resistor providing a reference voltage for said first integrated circuit means.

7. The motorized walker of claim 6 additionally comprising an eighth resistor electrically engaged from said first integrated circuit means across said second integrated circuit means and electrically engaging to said second resistor between said second and said third integrated circuit means; and a ninth resistor electrically engaging to said first resistor between said first and said second integrated circuit means and to said eighth resistor, said eighth and ninth resistor each having an ohmic value wherein the ratio of the ohmic value of the eighth resistor to the ohmic value of the ninth resistor determines the amplitude of a triangle wave generated by said second integrated circuit means.

8. The motorized walker of claim 7 additionally comprising a capacitor secured electrically across said second integrated circuit means to determined a period of oscillation of a square wave generated by the first integrated circuit means.

* * * * *